US006517312B1

(12) United States Patent
Jones et al.

(10) Patent No.: US 6,517,312 B1
(45) Date of Patent: Feb. 11, 2003

(54) TURBINE STATOR VANE SEGMENT HAVING INTERNAL COOLING CIRCUITS

(75) Inventors: Raymond Joseph Jones, Oxford, MA (US); James Lee Burns, Schenectady, NY (US); Parvangada Ganapathy Bojappa, Simpsonville, SC (US); Schotsch Margaret Jones, Greer, SC (US)

(73) Assignee: General Electric Company, Schenectady, NY (US)

( * ) Notice: Subject to any disclaimer, the term of this patent is extended or adjusted under 35 U.S.C. 154(b) by 18 days.

(21) Appl. No.: 09/533,195

(22) Filed: Mar. 23, 2000

(51) Int. Cl.[7] ..... F01D 7/00

(52) U.S. Cl. ..... 415/115; 416/97 R; 415/116

(58) Field of Search ..... 415/115, 116; 416/96 R, 96 A, 97 R

(56) References Cited

U.S. PATENT DOCUMENTS

| | | | | |
|---|---|---|---|---|
| 5,350,277 A | | 9/1994 | Jacala et al. | |
| 5,634,766 A | | 6/1997 | Cunha et al. | |
| 5,762,471 A | | 6/1998 | Cunha | |
| 6,099,244 A | * | 8/2000 | Tomita et al. | 415/115 |

OTHER PUBLICATIONS

"39$^{th}$ GE Turbine State–of–the–Art Technology Seminar", Tab 1, ""F" Technology—the First Half–Million Operating Hours", H.E. Miller, Aug. 1996.

"39th GE Turbine State–of–the–Art Technology Semincar", Tab 2, "GE Heavy–Duty Gas Turbine Performance Characteristics", F. J. Brooks, Aug. 1996.

"39th GE Turbine State–of–the–Art Technology Seminar", Tab 3, "9EC 50Hz 170–MW Class Gas Turbine", A. S. Arrao, Aug. 1996.

"39th GE Turbine State–of–the–Art Technology Seminar", Tab 4, "MWS6001FA—Advanced–Technology 70–MW Class 50/60 Hz Gas Turbine", Ramachandran et al., Aug. 1996.

"39th GE Turbine State–of–the–Art Technology Seminar", Tab 5, "Turbomachinery Technology Advances at Nuovo Pignone", Benvenuti et al., Aug. 1996.

"39th GE Turbine State–of–the–Art Technology Seminar", Tab 6, "GE Aeroderivative Gas Turbines—Design and Operating Features", M.W. Horner, Aug. 1996.

"39th GE Turbine State–of–the–Art Technology Seminar", Tab 7, "Advance Gas Turbine Materials and Coatings", P.W. Schilke, Aug. 1996.

"39th GE Turbine State–of–the–Art Technology Seminar", Tab 8, "Dry Low $NO_x$ Combustion Systems for GE Heavy-Duty Turbines", L. B. Davis, Aug. 1996.

"39th GE Turbine State–of–the–Art Technology Seminar", Tab 9, "GE Gas Turbine Combustion Flexibility", M. A. Davi, Aug. 1996.

(List continued on next page.)

*Primary Examiner*—Edward K. Look
*Assistant Examiner*—James M McAleenan
(74) *Attorney, Agent, or Firm*—Nixon & Vanderhye

(57) ABSTRACT

A turbine stator vane includes outer and inner walls each having outer and inner chambers and a vane extending between the outer and inner walls. The vane includes first, second, third, fourth and fifth cavities for flowing a cooling medium. The cooling medium enters the outer chamber of the outer wall, flows through an impingement plate for impingement cooling of the outer band wall defining in part the hot gas path and through openings in the first, second and fourth cavities for flow radially inwardly, cooling the vane. The spent cooling medium flows into the inner wall and inner chamber for flow through an impingement plate radially outwardly to cool the inner wall. The spent cooling medium flows through the third cavity for egress from the turbine vane segment from the outer wall. The first, second or third cavities contain inserts having impingement openings for impingement cooling of the vane walls. The fifth cavity provides air cooling for the trailing edge.

12 Claims, 4 Drawing Sheets

OTHER PUBLICATIONS

"39th GE Turbine State–of–the–Art Technology Seminar", Tab 10, "Gas Fuel Clean–Up System Design Considerations for GE Heavy–Duty Turbines", C. Wilkes, Aug. 1996.
"39th GE Turbine State–of–the–Art Technology Seminar", Tab 11, "Integrated Control Systems for Advanced Combined Cycles", Chu et al., Aug. 1996.
"39th GE Turbine State–of–the–Art Technology Seminar", Tab 12, "Power Systems for the 21st Century "H" Gas Turbine Combined Cycles", Paul et al., Aug. 1996.
"39th GE Turbine State–of–the–Art Technology Seminar", Tab 13, "Clean Coal and Heavy Oil Technologies for Gas Turbines", D. M. Todd, Aug. 1996.
"39th GE Turbine State–of–the–Art Technology Seminar", Tab 14, "Gas Turbine Conversions, Modifications and Uprates Technology", Stuck et al., Aug. 1996.
"39th GE Turbine State–of–the–Art Technology Seminar", Tab 15, "Performance and Reliability Improvements for Heavy–Duty Gas Turbines,"J. R. Johnson, Aug. 1996.
"39th GE Turbine State–of–the–Art Technology Seminar", Tab 16, "Gas Turbine Repair Technology", Crimi et al, Aug. 1996.
"39th GE Turbine State–of–the–Art Technology Seminar", Tab 17, "Heavy Duty Turbine Operating & Maintenance Considerations", R. F. Hoeft, Aug. 1996.
"39th GE Turbine State–of–the–Art Technology Seminar", Tab 18, "Gas Turbine Performance Monitoring and Testing", Schmitt et al., Aug. 1996.
"39th GE Turbine State–of–the–Art Technology Seminar", Tab 19, "Monitoring Service Delivery System and Diagnostics", Madej et al., Aug. 1996.
"39th GE Turbine State–of–the–Art Technology Seminar", Tab 20, "Steam Turbines for Large Power Applications", Reinker et al., Aug. 1996.
"39th GE Turbine State–of–the–Art Technology Seminar", Tab 21, "Steam Turbines for Ultrasupercritical Power Plants", Retzlaff et al., Aug. 1996.
"39th GE Turbine State–of–the–Art Technology Seminar", Tab 22, "Steam Turbine Sustained Efficiency", P. Schofield, Aug. 1996.
"39th GE Turbine State–of–the–Art Technology Seminar", Tab 23, "Recent Advances in Steam Turbines for Industrial and Cogeneration Applications", Leger et al., Aug. 1996.
"39th GE Turbine State–of–the–Art Technology Seminar", Tab 24, "Mechanical Drive Steam Turbines", D. R. Leger, Aug. 1996.
"39th GE Turbine State–of–the–Art Technology Seminar", Tab 25, "Steam Turbines for STAG™ Combined–Cycle Power Systems", M. Boss, Aug. 1996.
"39th GE Turbine State–of–the–Art Technology Seminar", Tab 26, "Cogeneration Applicatins Considerations", Fisk et al., Aug. 1996.
"39th GE Turbine State–of–the–Art Technology Seminar", Tab 27, "Performance and Economic Considerations of Repowering Steam Power Plants", Stoll et al., Aug. 1996.
"39th GE Turbine State–of–the–Art Technology Seminar", Tab 28, "High–Power–Density™ Steam Turbine Design Evolution", J. H. Moore, Aug. 1996.
"39th GE Turbine State–of–the–Art Technology Seminar", Tab 29, "Advances in Steam Path Technologies", Cofer, IV, et al., Aug. 1996.
"39th GE Turbine State–of–the–Art Technology Seminar", Tab 30, "Upgradable Opportunities for Steam Turbines", D. R. Dreier, Jr., Aug. 1996.
"39th GE Turbine State–of–the–Art Technology Seminar", Tab 31, "Uprate Options for Industrial Turbines", R. C. Beck, Aug. 1996.
"39th GE Turbine State–of–the–Art Technology Seminar", Tab 32, "Thermal Performance Evaluation and Assessment of Steam Turbine Units", P. Albert, Aug. 1996.
"39th GE Turbine State–of–the–Art Technology Seminar", Tab 33, "Advances in Welding Repair Technology" J. F. Nolan, Aug. 1996.
"39th GE Turbine State–of–the–Art Technology Seminar", Tab 34, "Operation and Maintenance Strategies to Enhance Plant Profitability", MacGillivray et al., Aug. 1996.
"39th GE Turbine State–of–the–Art Technology Seminar", Tab 35, "Generator Insitu Inspections", D. Stanton.
"39th GE Turbine State–of–the–Art Technology Seminar", Tab 36, "Generator Upgrade and Rewind", Halpern et al., Aug. 1996.
"39th GE Turbine State–of–the–Art Technology Seminar", Tab 37, "GE Combined Cycle Product Line and Performance", Chase, et al., Aug. 1996.
"39th GE Turbine State–of–the–Art Technology Seminar", Tab 38, "GE Combined Cycle Experience", Maslak et al., Aug. 1996.
"39th GE Turbine State–of–the–Art Technology Seminar", Tab 39, "Single–Shaft Combined Cycle Power Generation Systems", Tomlinson et al., Aug. 1996.
"Advanced Turbine System Program—Conceptual Design and Product Development", Annual Report, Sep. 1, 1994–Aug. 31, 1995.
"Advanced Turbine Systems (ATS Program) Conceptual Design and Product Development", Final Technical Progress Report, vol. 2–Industrial Machine, Mar. 31, 1997, Morgantown, WV.
"Advanced Turbine Systems (ATS Program), Conceptual Design and Product Development", Final Technical Progress Report, Aug. 31, 1996, Morgantown, WV.
"Advanced Turbine Systems (ATS) Program, Phase 2, Conceptual Design and Product Development", Yearly Technical Progress Report, Reporting Period: Aug. 25, 1993–Aug. 31, 1994.
"Advanced Turbine Systems" Annual Program Review, Preprints, Nov. 2–4, 1998, Washington, D.C. U.S. Department of Energy, Office of Industrial Technologies Federal Energy Technology Center.
"ATS Conference" Oct. 28, 1999, Slide Presentation.
"Baglan Bay Launch Site", various articles relating to Baglan Energy Park.
"Baglan Energy Park", Brochure.
"Commercialization", Del Williamson, Present, Global Sales, May 8, 1998.
"Environmental, Health and Safety Assessment, ATS 7H Program (Phase 3R) Test Activities at the GE Power Systems Gas Turbine Manufacturing Facility, Greenville, SC", Document #1753, Feb. 1998, Publication Date: Nov. 17, 1998, Report Nos. DE–FC21–95MC31176—11.
"Exhibit panels used at 1995 product introduction at PowerGen Europe".
"Extensive Testing Program Validates High Efficiency reliability of GE's Advanced "H" Gas Turbine Technology", Press Information, Press Release, 96–NR14, Jun. 26, 1996, H Technology Tests/pp. 1–4.

"Extensive Testing Program Validates High Efficiency, Reliability of GE's Advanced "H" Gas Turbine Technology", GE Introduces Advanced Gas Turbine Technology Platform: First to Reach 60% Combined–Cycle Power Plant Efficiency, Press Information, Press Release, Power–Gen Europe '95, 95–NRR15, Advanced Technology Introduction/pp. 1–6.
"Gas, Steam Turbine Work as Single Unit in GE's Advanced H Technology Combined–Cycle System", Press Information, Press Release, 95–NR18, May 16, 1995, Advanced Technology Introduction/pp. 1–3.
"GE Breaks 60% Net Efficiency Barrier" paper, 4 pages.
"GE Businesses Share Technologies and Experts to Develop State–Of–The–Art Products", Press Information, Press Release 95–NR10, May 16, 1995, GE Technology Transfer/pp. 1–3.
"General Electric ATS Program Technical Review, Phase 2 Activities", T. Chance et al., pp. 1–4.
"General Electric's DOE/ATS H Gas Turbine Development" Advanced Turbine Systems Annual Review Meeting, Nov. 7–8, 1996, Washington, D. C., Publication Release.
"H Technology Commercialization", 1998 MarComm Activity Recommendation, Mar., 1998.
"H Technology", Jon Ebacher, VP, Power Gen Technology, May 8, 1998.
"H Testing Process", Jon Ebacher, VP, Power Gen Technology, May 8, 1998.
"Heavy–Duty & Aeroderivative Products" Gas Turbines, Brochure, 1998.
"MS7001H/MS9001H Gas Turbine, gepower.com website for PowerGen Europe" Jun. 1–3 going public Jun. 15, (1995).
"New Steam Cooling System is a Key to 60% Efficiency For GE "H" Technology Combined–Cycle Systems", Press Information, Press Release, 95–NRR16, May 16, 1995, H Technology/pp. 1–3.
"Overview of GE's H Gas Turbine Combined Cycle", Jul. 1, 1995 to Dec. 31, 1997.
"Power Systems for the 21st Century—"H" Gas Turbine Combined Cycles", Thomas C. Paul et al., Report.
"Power–Gen International", 1998 Show Guide, Dec. 9–11, 1998, Orange County Convention Center, Orlando, Florida.
"Press Coverage following 1995 product announcement"; various newspaper clippings relating to improved generator.
"Proceedings of the Advanced Turbine Systems Annual Program Review Meeting", vol. I, "Industrial Advanced Turbine Systems Program Overview", D. W. Esbeck, p. 3–13, Oct., 1995.
"Proceedings of the Advanced Turbine Systems Annual Program Review Meeting", vol. I, "H Gas Turbine Combined Cycle", J. Corman, p. 14–21, Oct., 1995.
"Proceedings of the Advanced Turbine Systems Annual Program Review Meeting", vol. I, "Overview of Westinghouse's Advanced Turbine Systems Program", Bannister et al., p. 22–30, Oct., 1995.
"Proceedings of the Advanced Turbine Systems Annual Program Review Meeting", vol. I, "Allison Engine ATS Program Technical Review", D. Mukavetz, p. 31–42, Oct., 1995.
"Proceedings of the Advanced Turbine Systems Annual Program Review Meeting", vol. I, "Advanced Turbine Systems Program Industrial System Concept Development", S. Gates, p. 43–63, Oct., 1995.
"Proceedings of the Advanced Turbine Systems Annual Program Review Meeting", vol. I, "Advanced Turbine System Program Phase 2 Cycle Selection", Latcovich, Jr., p. 64–69, Oct., 1995.
"Proceedings of the Advanced Turbine Systems Annual Program Reveiw Meeting", vol. I, "General Electric ATS Program Technical Review Phase 2 Activities", Chance et al., p. 70–74, Oct., 1995.
"Proceedings of the Advanced Turbine Systems Annual Program Review Meeting", vol. I, "Technical Review of Westinghouse's Advanced Turbine Systems Program", Diakunchak et al., p. 75–86, Oct., 1995.
"Proceedings of the Advanced Turbine Systems Annual Program Review Meeting", vol. I, "Advanced Combustion Turbines and Cycles: An EPRI Perspectives", Touchton et al., p. 87–88, Oct., 1995.
"Proceedings of the Advanced Turbine Systems Annual Program Review Meeting", vol. I, "Advanced Turbine Systems Annual Program Review", William E. Koop, p. 89–92, Oct., 1995.
"Proceedings of the Advanced Turbine Systems Annual Program Review Meeting", vol. I, "The AGTSR Consortium: An Update", Fant et al., p. 93–102, Oct., 1995.
"Proceedings of the Advanced Turbine Systems Annual Program Review Meeting", vol. I, "Overview of Allison/AGTSR Interactions", Sy A. Ali, p. 103–106, Oct., 1995.
"Proceedings of the Advanced Turbine Systems Annual Program Review Meeting", vol. I, "Design Factors for Stable Lean Premix Combustion", Richards et al., p. 107–113, Oct., 1995.
"Proceedings of the Advanced Turbine Systems Annual Program Review Meeting", vol. I, "Ceramic Stationary as Turbine", M. van Roode, p. 114–147, Oct., 1995.
"Proceedings of the Advanced Turbine Systems Annual Program Review Meeting", vol. I, "DOE/Allison Ceramic Vane Effort", Wenglarz et al., p. 148–151, Oct., 1995.
"Proceedings of the Advanced Turbine Systems Annual Program Review Meeting", vol. I, "Materials/Manufacturing Element of the Advanced Turbine Systems Program", Karnitz et al., p. 152–160, Oct., 1995.
"Proceedings of the Advanced Turbine Systems Annual Program Review Meeting", vol. I, "Land–Based Turbine Casting Initiative", Mueller et al., p. 161–170, Oct., 1995.
"Proceedings of the Advanced Turbine Systems Annual Program Review Meeting", vol. I, "Pratt & Whitney Thermal Barrier Coatings", Bornstein et al., p. 182–193, Oct., 1995.
"Proceedings of the Advanced Turbine Systems Annual Program Review Meeting", vol. I, "Westinhouse Thermal Barrier Coatings", Goedjen et al., p. 194–199, Oct., 1995.
"Proceedings of the Advanced Turbine Systems Annual Program Review Meeting", vol. I, "High Performance Steam Development", Duffy et al., p. 200–220, Oct., 1995.
"Proceedings of the Advanced Turbine Systems Annual Program Review Meeting", vol. II, "Lean–Premixed Combustion Stabilized by Radiation Feedback and heterogeneous Catalysis", Dibble et al., p. 221–232, Oct., 1995.
"Proceedings of the Advanced Turbine Systems Annual Program Review Meeting", vol. II, Rayleigh/Raman/LIF Measurements in a Turbulent Lean Premixed Combustor, Nandula et al. p. 233–248, Oct., 1995.

"Proceedings of the Advanced Turbine Systems Annual Program Review Meeting", vol. II, "Lean Premixed Flames for Low $No_x$ Combustors", Sojka et al., p. 249–275, Oct., 1995.

"Proceedings of the Advanced Turbine Systems Annual Program Review Meeting", vol. II, "Functionally Gradient Materials for Thermal Barrier Coatings in Advanced Gas Turbine Systems", Banovic et al., p. 276–280, Oct., 1995.

"Proceedings of the Advanced Turbine Systems Annual Program Review Meeting", vol. II, "Advanced Turbine Cooling, Heat Transfer, and Aerodynamic Studies", Han et al., p. 281–309, Oct., 1995.

"Proceedings of the Advanced Turbine Systems Annual Program Review Meeting", vol. II, "Life Prediction of Advanced Materials for Gas Turbine Application", Zamrik et al., p. 310–327, Oct., 1995.

"Proceedings of the Advanced Turbine Systems Annual Program Review Meeting", vol. II, "Advanced Combustion Technologies for Gas Turbine Power Plants", Vandsburger et al., p. 328–352, Oct., 1995.

"Proceedings of the Advanced Turbine Systems Annual Program Review Meeting", vol. II, "Combustion Modeling in Advanced Gas Turbine Systems", Smoot et al., p. 353–370, Oct., 1995.

"Proceedings of the Advanced Turbine Systems Annual Program Review Meeting", vol. II, "Heat Transfer in a Two–Pass Internally Ribbed Turbine Blade Coolant Channel with Cylindrical Vortex Generators", Hibbs et al. p. 371–390, Oct., 1995.

"Proceedings of the Advanced Turbine Systems Annual Program Review Meeting", vol. II, "Rotational Effects on Turbine Blade Cooling", Govatzidakia et al., p. 391–392, Oct., 1995.

"Proceedings of the Advanced Turbine Systems Annual Program Review Meeting", vol. II, "Manifold Methods for Methane Combustion", Yang et al., p. 393–409, Oct., 1995.

"Proceedings of the Advanced Turbine Systems Annual Program Review Meeting", vol. II, "Advanced Multistage Turbine Blade Aerodynamics, Performance, Cooling, and Heat Transfer", Fleeter et al., p. 410–414, Oct., 1995.

"Proceedings of the Advanced Turbine Systems Annual Program Review Meeting", vol. II, The Role of Reactant Unmixedness, Strain Rate, and Length Scale on Premixed Combustor Performance, Samuelsen et al., p. 415–422, Oct., 1995.

"Proceedings of the Advanced Turbine Systems Annual Program Review Meeting", vol. II, "Experimental and Computational Studies of Film Cooling With Compound Angle Injection", Goldstein et al., p. 423–451, Oct., 1995.

"Proceedings of the Advanced Turbine Systems Annual Program Review Meeting", vol. II, "Compatibility of Gas Turbine Materials with Steam Cooling", Desai et al., p. 452–464, Oct., 1995.

"Proceedings of the Advanced Turbine Systems Annual Program Review Meeting", vol. II, "Use of a Laser–Induced Fluorescence Thermal Imaging System for Film Cooling Heat Transfer Measurement", M. K. Chy, p. 465–473, Oct., 1995.

"Proceedings of the Advanced Turbine Systems Annual Program Review Meeting", vol. II, Effects of Geometry on Slot–Jet Film Cooling Performance, Hyams et al., p. 474–496, Oct., 1995.

"Proceedings of the Advanced Turbine Systems Annual Program Review Meeting", vol. II, "Steam as Turbine Blade Coolant: Experimental Data Generation", Wilmsen et al., p. 497–505, Oct., 1995.

"Proceedings of the Advanced Turbine Systems Annual Program Review Meeting", vol. II, "Combustion Chemical Vapor Deposited Coatings for Thermal Barrier Coating Systems", Hampikian et al., p. 506–515, Oct., 1995.

"Proceedings of the Advanced Turbine Systems Annual Program Review Meeting", vol. II, "Premixed Burner Experiments: Geometry, Mixing, and Flame Structure Issues", Gupta et al., p. 516–528, Oct., 1995.

"Proceedings of the Advanced Turbine Systems Annual Program Review Meeting", vol. II, "Intercooler Flow Path for Gas Turbines: CFD Design and Experiments", Agrawal et al., p. 529–538, Oct., 1995.

"Proceedings of the Advanced Turbine Systems Annual Program Review Meeting", vol. II, "Bond Strength and Stress Measurements in Thermal Barrier Coatings", Gell et al., p. 539–549, Oct., 1995.

"Proceedings of the Advanced Turbine Systems Annual Program Review Meeting", vol. II, "Active Control of Combustion Instabilities in Low $NO_x$ Gas Turbines", Zinn et al., p. 550–551, Oct., 1995.

"Proceedings of the Advanced Turbine Systems Annual Program Review Meeting", vol. II, "Combustion Instability Modeling and Analysis", Santoro et al., p. 552–559, Oct., 1995.

"Proceedings of the Advanced Turbine Systems Annual Program Review Meeting", vol. II, "Flow and Heat Transfer in Gas Turbine Disk Cavities Subject to Nonuniform External Pressure Field", Roy et al., p. 560–565, Oct., 1995.

"Proceedings of the Advanced Turbine Systems Annual Program Review Meeting", vol. II, "Heat Pipe Turbine Vane Cooling", Langston et al., p. 566–572, Oct., 1995.

"Proceedings of the Advanced Turbine Systems Annual Program Review Meeting", vol. II, "Improved Modeling Techniques for Turbomachinery Flow Fields", Lakshminarayana et al., p. 573–581, Oct., 1995.

"Proceedings of the Advanced Turbine Systems Annual Program Review Meeting", vol. II, "Advanced 3D Inverse Method for Designing Turbomachine Blades", T. Dang, p. 582, Oct., 1995.

"Proceedings of the Advanced Turbine Systems Annual Program Review Meeting", vol. II, "ATS and the Industries of the Future", Denise Swink, p. 1, Nov., 1996.

"Proceedings of the Advanced Turbine Systems Annual Program Review Meeting", vol. II, "Gas Turbine Association Agenda", William H. Day, p. 3–16, Nov., 1996.

"Proceedings of the Advanced Turbine Systems Annual Program Review Meeting", vol. II, "Power Needs in the Chemical Industry", Keith Davidson, p. 17–26, Nov., 1996.

"Proceedings of the Advanced Turbine Systems Annual Program Review Meeting", vol. II, "Advanced Turbine Systems Program Overview", David Esbeck, p. 27–34, Nov., 1996.

"Proceedings of the Advanced Turbine Systems Annual Program Review Meeting", vol. II, "Westinghouse's Advanced Turbine Systems Program", Gerard McQuiggan, p. 35–48, Nov., 1996.

"Proceedings of the Advanced Turbine Systems Annual Program Review Meeting", vol. II, "Overview of GE's H Gas Turbine Combined Cycle", Cook et al., p. 49–72, Nov., 1996.

"Proceedings of the Advanced Turbine Systems Annual Program Review Meeting", vol. II, "Allison Advanced Simple Cycle Gas Turbine System", William D. Weisbrod, p. 73–94, Nov., 1996.
"Proceedings of the Advanced Turbine Systems Annual Program Review Meeting", "The AGTSR Industry–University Consortium", Lawrence P. Golan, p. 95–110, Nov., 1996.
"Proceeedings of the Advanced Turbine Systems Annual Program Review Meeting", "$NO_x$ and CO Emissions Models for Gas–Fired Lean–Premixed Combustion Turbines", A. Mellor, p. 111–122, Nov., 1996.
"Proceedings of the Advanced Turbine Systems Annual Program Review Meeting", "Methodologies for Active Mixing and Combustion Control", Uri Vandsburger, p. 123–156, Nov., 1996.
"Proceedings of the Advanced Turbine Systems Annual Program Review Meeting", "Combustion Modeling in Advanced Gas Turbine Systems", Paul O. Hedman, p. 157–180, Nov., 19967.
"Proceedings of the Advanced Turbine Systems Annual Program Review Meeting", "Manifold Methods for Methane Combustion", Stephen B. Pope, p. 181–188, Nov., 1996.
"Proceedings of the Advanced Turbine Systems Annual Program Review Meeting", "The Role of Reactant Unmixedness, Strain Rate, and Length Scale on Premixed Combustor Performance", Scott Samuelsen, p. 189–210, Nov., 1996.
"Proceedings of the Advanced Turbine Systems Annual Program Review Meeting", "Effect of Swirl and Momentum Distribution on Temperature Distribution in Premixed Flames", Ashwani K. Gupta, p. 211–232, Nov., 1996.
"Proceedings of the Advanced Turbine Systems Annual Program Review Meeting", "Combustion Instability Studies Application to Land–Based Gas Turbine Combustors", Robert J. Santoro, p. 233–252.
"Proceedings of the Advanced Turbine Systems Annual Program Review Meeting", "Active Control of Combustion Instabilities in Low $NO_x$ Turbines", Ben T. Zinn, p. 253–264, Nov., 1996.
"Proceedings of the Advanced Turbine Systems Annual Program Review Meeting", "Life Prediction of Advanced Materials for Gas Turbine Application", Sam Y. Zamrik, p. 265–274, Nov., 1996.
"Proceedings of the Advanced Turbine Systems Annual Program Review Meeting", "Combustion Chemical Vapor Deposited Coatings for Thermal Barrier Coating Systems", W. Brent Carter, p. 275–290, Nov., 1996.
"Proceedings of the Advanced Turbine Systems Annual Program Review Meeting", "Compatibility of Gas Turbine Materials with Steam Cooling", Vimal Desai, p. 291–314, Nov., 1996.
"Proceedings of the Advanced Turbine Systems Annual Program Review Meeting", "Bond Strength and Stress Measurements in Thermal Barrier Coatings", Maurice Gell, p. 315–334, Nov., 1996.
"Proceedings of the Advanced Turbine Systems Annual Program Review Meeting", "Advanced Multistage Turbine Blade Aerodynamics, Performance, Cooling and Heat Transfer", Sanford Fleeter, p. 335–356, Nov., 1996.
"Proceedings of the Advanced Turbine Systems Annual Program Review Meeting", "Flow Characteristics of an Intercooler System for Power Generating Gas Turbines", Ajay K. Agrawal, p. 357–370, Nov., 1996.
"Proceedings of the Advanced Turbine Systems Annual Program Review Meeting", "Improved Modeling Techniques for Turbomachinery Flow Fields", B. Lakshiminarayana, p. 371–392, Nov., 1996.
"Proceedings of the Advanced Turbine Systems Annual Program Review Meeting", "Development of an Advanced 3d & Viscous Aerodynamics Design Method for Turbomachine Components in Utility and Industrial Gas Turbine Applications", Thong Q. Dang, p. 393–406, Nov., 1996.
"Proceedings of the Advanced Turbine Systems Annual Program Review Meeting", "Advanced Turbine Cooling, Heat Transfer, and Aerodynamics Studies", Je–Chin Han, p. 407–426, Nov., 1996.
"Proceedings of the Advanced Turbine Systems Annual Program Review Meeting", "Heat Transfer in a Two–Pass Internally Ribbed Turbine Blade Coolant Channel with Vortex Generators", S. Archarya, p. 427–446.
"Proceedings of the Advanced Turbine Systems Annual Program Review Meeting", "Experimental and Computational Studies of Film Cooling with Compound Angle Injection", R. Goldstein, p. 447–460, Nov., 1996.
"Proceedings of the Advanced Turbine Systems Annual Program Review Meeting", "Study of Endwall Film Cooling with a Gap Leakage Using a Thermographic Phosphor Fluorescence Imaging System", Mingking K. Chyu, p. 461–470, Nov., 1996.
"Proceedings of the Advanced Turbine Systems Annual Program Review Meeting", "Steam as a Turbine Blade Coolant: External Side Heat Transfer", Abraham Engeda, p. 471–482, Nov., 1996.
"Proceedings of the Advanced Turbine Systems Annual Program Review Meeting", "Flow and Heat Transfer in Gas Turbine Disk Cavities Subject to Nonuniform External Pressure Field", Ramendra Roy, p. 483–498, Nov., 1996.
"Proceedings of the Advanced Turbine Systems Annual Program Review Meeting", "Closed–Loop Mist/Steam Cooling for Advanced Turbine Systems", Ting Wang, p. 499–512, Nov., 1996.
"Proceedings of the Advanced Turbine Systems Annual Program Review Meeting", "Heat Pipe Turbine Vane Cooling", Langston et al., p. 513–534, Nov., 1996.
"Proceedings of the Advanced Turbine Systems Annual Program Review Meeting", "EPRI's Combustion Turbine Program: Status and Future Directions", Arthur Cohn, p. 535,–552 Nov., 1996.
"Proceedings of the Advanced Turbine Systems Annual Program Review Meeting", "ATS Materials Support", Michael Karnitz, p. 553–576, Nov., 1996.
"Proceedings of the Advanced Turbine Systems Annual Program Review Meeting", "Land Based Turbine Casting Initiative", Boyd A. Mueller, p. 577–592, Nov., 1996.
"Proceedings of the Advanced Turbine Systems Annual Program Review Meeting", "Turbine Airfoil Manufacturing Technology", Charles S. Kortovich, p. 593–622, Nov., 1996.
"Proceedings of the Advanced Turbine Systems Annual Program Review Meeting", "Hot Corrosion Testing of TBS's", Norman Bornstein, p. 623–631, Nov., 1996.
"Proceedings of the Advanced Turbine Systems Annuual Program Review Meeting", "Ceramic Stationary Gas Turbine", Mark van Roode, p. 633–658, Nov., 1996.
"Proceedings of the Advanced Turbine Systems Annual Program Review Meeting", "Western European Status of Ceramics for Gas Turbines", Tibor Bornemisza, p. 659–670, Nov., 1996.

"Proceedings of the Advanced Turbine Systems Annual Program Review Meeting", "Status of Ceramic Gas Turbines in Russia", Mark van Roode, p. 671, Nov., 1996.
"Status Report: The U.S. Department of Energy's Advanced Turbine systems Program", facsimile dated Nov. 7, 1996.
"Testing Program Results Validate GE's H Gas Turbine—High Efficiency, Low Cost of Electricity and Low Emissions", Roger Schonewald and Patrick Marolda, (no date available).
"Testing Program Results Validate GE's H Gas Turbine—High Efficiency, Low Cost of Electricity and Low Emissions", Slide Presentation—working draft, (no date available).
"The Next Step In H . . . For Low Cost Per kW–Hour Power Generation", LP–1 PGE '98.
"Utility Advanced Turbine System (ATS) Technology Readiness Testing and Pre–Commercialization Demonstration", Document #486040, Oct. 1–Dec. 31, 1996, Publication Date, Jun. 1, 1997, Report Nos.: DOE/MC/31176—5628.
"Utility Advanced Turbine Systems (ATS) Technology Readiness Testing—Phase 3", Document #666274, Oct. 1, 1996–Sep. 30, 1997, Publication Date, Dec. 31, 1997, Report Nos.: DOE/MC/31176—10.
"Utility Advanced Turbine Systems (ATS) Technology Readiness Testing and Pre–Commercial Demonstration, Phase 3", Document #486029, Oct. 1–Dec. 31, 1995, Publication Date, May 1, 1997, Report Nos.: DOE/MC/31176—5340.
"Utility Advanced Turbine System (ATS) Technology Readiness Testing and Pre–Commercial Demonstration—Phase 3", Document #486132, Apr. 1–Jun. 30, 1976, Publication Date, Dec. 31, 1996, Report Nos.: DOE/MC/31176—5660.
"Utility Advanced Turbine System (ATS) Technology Readiness Testing and Pre–Commercial Demonstration—Phase 3", Document #587906, Jul. 1–Sep. 30, 1995, Publication Date, Dec. 31, 1995, Report Nos.: DOE/MC/31176—5339.
"Utility Advanced Turbine System (ATS) Technology Readiness Testing and Pre–Commercial Demonstration" Document #666277, Apr. 1–Jun. 30, 1997, Publication Date, Dec. 31, 1997, Report Nos.: DOE/MC/31176—8.
"Utility Advanced Turbine System (ATS) Technology Readiness Testing and Pre–Commercialization Demonstration" Jan. 1–Mar. 31, 1996, DOE/MC/31176—5338.
"Utility Advanced Turbine System (ATS) Technology Readiness Testing: Phase 3R", Document #756552, Apr. 1–Jun. 30, 1999, Publication Date, Sep. 1, 1999, Report Nos.: DE–FC21–95MC31176—23.
"Utility Advanced Turbine System (ATS) Technology Testing.", Document #656823, Jan. 1–Mar. 31, 1998, Publication Date, Aug. 1, 1998, Report Nos.: DOE/MC/31176—17.
"Utility Advanced Turbine System (ATS) Technology Testing and Pre–Commercial Demonstration", Annual Technical Progress Report, Reporting Period: Jul. 1, 1995–Sep. 30, 1996.
"Utility Advanced Turbine System (ATS) Technology Testing", Phase 3R, Annual Technical Progress Report, Reporting Period: Oct. 1, 1997–Sep. 30, 1998.
"Utility Advanced Turbine System (ATS) Technology Testing", Document #750405, Oct. 1–Dec. 30, 1998, Publication Date: May 1, 1999, Report Nos.: DE–FC21–95MC31176—20.
"Utility Advanced Turbine Systems (ATS) Technology Testing", Document #1348. Apr. 1–Jun. 29, 1998, Publication Date Oct. 29, 1998, Report Nos. DE–FC21–95MC31176—18.
"Utility Advanced Turbine System (ATS) Technology Readiness Testing and Pre–Commercial Demonstration", Quarterly Report, Jan. 1–Mar. 31, 1997, Document #666275, Report Nos.: DOE/MC/31176–07.
"Proceedings of the 1997 Advanced Turbine Systems", Annual Program Review Meeting, Oct. 28–29, 1997.

* cited by examiner

TURBINE STATOR VANE SEGMENT HAVING INTERNAL COOLING CIRCUITS

This invention was made with Government support under Contract No. DE-FC21-95MC31176 awarded by the Department of Energy. The Government has certain rights in this invention.

BACKGROUND OF THE INVENTION

The present invention relates generally to land-based gas turbines, for example, for electrical power generation, and particularly to internal cooling circuits for the nozzle segments of the gas turbine.

Traditionally, compressor bleed air is extracted from the turbine's compressor for cooling the turbine blades and nozzles. Diversion of cooling air, however, represents a parasitic loss to turbine efficiency. More recently, advanced gas turbine designs have recognized that the hot gas path flow temperature could exceed the melting temperature of the turbine components, necessitating a different cooling scheme to protect those hot gas path components during operation. Steam as a cooling medium has been recognized as superior to air because steam has a higher heat capacity. A gas turbine employing steam as a cooling medium for the nozzle segments has been proposed, for example, in U.S. Pat. No. 5,674,766 of common assignee herewith.

In the cooling scheme set forth in that patent, the inner and outer walls or bands of the nozzle segments between which the nozzle vanes extend are compartmentalized to provide impingement cooling along the outer and inner walls of the segment. Cooling steam is also provided along the walls of the vanes. To accomplish that, the cooling steam is supplied to a first chamber of the outer wall, where it passes through impingement openings in an impingement plate for impingement cooling the outer wall. The steam is then passed radially inwardly through the first and fifth cavities of each stator vane for flow through inserts in those cavities. The inserts have openings and the steam flows through the openings to impingement cool registering portions of the stator vane walls. The steam then flows into an inner chamber of an inner wall and reverses direction for flow radially outwardly through openings in an impingement plate to impingement cool the inner wall. The spent cooling medium then flows radially outwardly through three intermediate cavities, each having an insert with openings for impingement cooling the adjacent walls of the vane. The spent cooling steam then flows outwardly of the segment.

Additionally, air is supplied to a cavity extending adjacent the trailing edge of the vane for cooling the trailing edge. The air flows past turbulators and exits into the hot gas stream through openings in the trailing edge. While the foregoing described design has many advantages, it is desirable to have a more robust design with reduced casting costs and complexity, as well as a reduced number of inserts.

BRIEF SUMMARY OF THE INVENTION

In accordance with a preferred form of the present invention, a nozzle stage is provided having a cooling circuit, e.g., steam and air, of reduced complexity and cost, while meeting cycle requirements. Particularly, the cooling scheme of the present invention for the nozzle stage includes outer and inner bands with vanes extending therebetween. Similarly as in the above-mentioned patent, the inner and outer bands are compartmentalized for impingement cooling of the walls defining the gas path. The present invention, however, provides a cooling circuit within each vane having a flow pattern significantly different from the flow pattern of the prior patent affording the above-mentioned advantages. The present invention provides first, second, third, fourth and fifth cavities between the inner and outer bands of each vane segment. The cavities in each vane are arranged sequentially in that order from the leading edge to the trailing edge. After impingement cooling the gas path wall of the outer band, steam from the outer band flows generally radially inwardly through inserts in the first and second cavities and through openings in the inserts for impingement cooling the registering wall surfaces of the vane. Steam is also supplied to the fourth cavity for flow radially inwardly. However, the fourth cavity does not have an insert and the walls of the vane defining the fourth cavity are not impingement cooled. Rather, they are convectively cooled. Thus, the cooling medium is supplied the first, second and fourth cavities at a relatively low temperature, affording improved cooling adjacent the leading and trailing edges, the hottest portions of the vanes. The steam flowing into the inner band compartment passes through an impingement plate for impingement cooling of the inner band. Spent cooling steam is supplied to the third vane cavity. An insert in the third cavity has openings for impingement cooling of the registering wall surfaces of the vane. The spent cooling steam then flows outwardly of the third cavity for flow generally radially outwardly of the vane segment. The fifth cavity is air-cooled by compressor bleed air. Turbulators are also disposed in the fifth cavity. However, the fifth cavity is closed and does not exhaust air to the hot gas path stream. Rather, the spent cooling air is exhausted into the wheelspace.

In a preferred embodiment according to the present invention, there is provided a turbine vane segment, comprising inner and outer bands spaced from one another and having inner and outer walls, respectively, in part defining a gas path through the turbine, a vane extending in the gas path between the inner and outer bands and having leading and trailing edges, the vane including a plurality of discrete cavities between the leading and trailing edges and extending lengthwise of the vane for flowing a cooling medium, a cooling medium inlet for the segment for enabling passage of the cooling medium into a compartment of the outer wall, the cavities including first, second, third, fourth and fifth cavities in sequential order from the leading edge toward the trailing edge, the vane having openings in communication with the compartment and the first, second and fourth cavities to enable passage of the cooling medium from the compartment into the first, second and fourth cavities for flow in a generally radially inward direction along the first, second and fourth cavities, the vane having openings in communication between a compartment of the inner wall and the first, second and fourth cavities for flowing the cooling medium from the first, second and fourth cavities into the compartment of the inner band, the vane having an opening in communication with the compartment of the inner band and the third cavity for flowing the cooling medium generally radially outwardly through the third cavity and outwardly of the vane segment.

In a further preferred embodiment according to the present invention, there is provided a turbine vane segment, comprising inner and outer bands spaced from one another and having inner and outer walls, respectively, in part defining a gas path through the turbine, a vane extending in the gas path between the inner and outer bands and having leading and trailing edges, the vane including a plurality of discrete cavities between the leading and trailing edges and extending lengthwise of the vane for flowing a cooling medium, a first cover for the outer band spaced outwardly of the outer wall, a first impingement plate between the first cover and the outer wall in part defining outer and inner chambers on opposite sides of the impingement plate, a cooling medium inlet for the segment for enabling passage of the cooling medium into the outer chamber, the impingement plate having openings for flowing the cooling medium from the outer chamber into the inner chamber through the openings for impingement cooling of the outer wall, the cavities including first, second, third, fourth and fifth cavities in sequential order from the leading edge toward the trailing edge, the vane having openings in communication with the inner chamber and the first, second and fourth cavities to enable passage of the cooling medium from the inner chamber into the first, second and fourth cavities for flow in a generally radially inward direction along the first, second and fourth cavities, a second cover for the inner band spaced inwardly from the inner wall, a second impingement plate between the second cover and the inner wall in part defining outer and inner chambers on opposite sides of the second impingement plate, the vane having openings in communication with the inner chamber of the inner wall and the first, second and fourth cavities for flowing the cooling medium from the first, second and fourth cavities into the inner chamber of the inner band, the second impingement plate having openings for flowing the cooling medium from the inner chamber of the inner band through the openings of the second impingement plate into the outer chamber of the inner band for impingement cooling the inner wall, the vane having an opening in communication with the outer chamber of the inner band and the third cavity for flowing the cooling medium generally radially outwardly through the third cavity and outwardly of the vane segment.

DETAILED DESCRIPTION OF THE INVENTION

Figure 1:
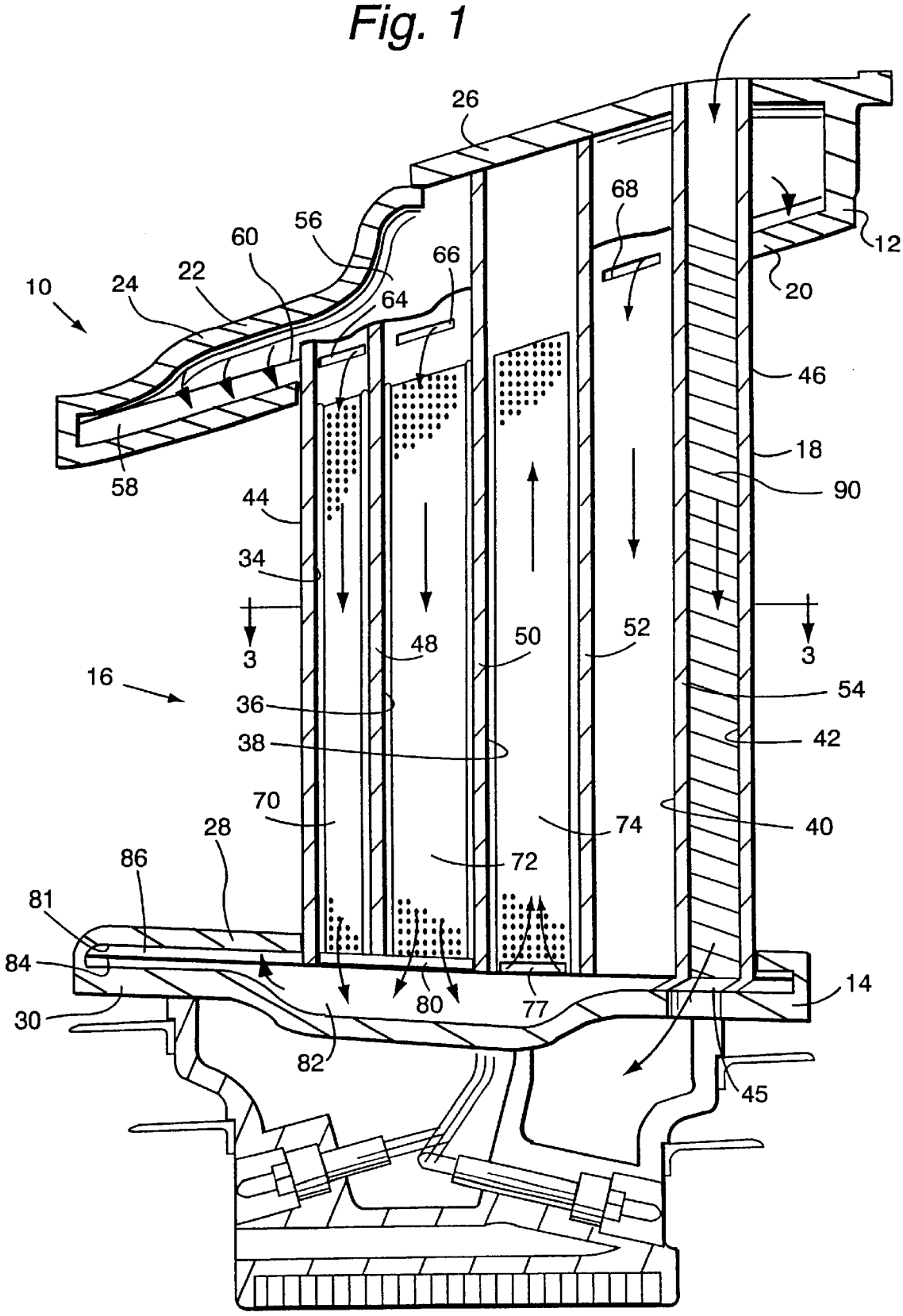
FIG. 1 is a schematic side cross-sectional view of a stator vane segment according to the present invention.
Figure 3:
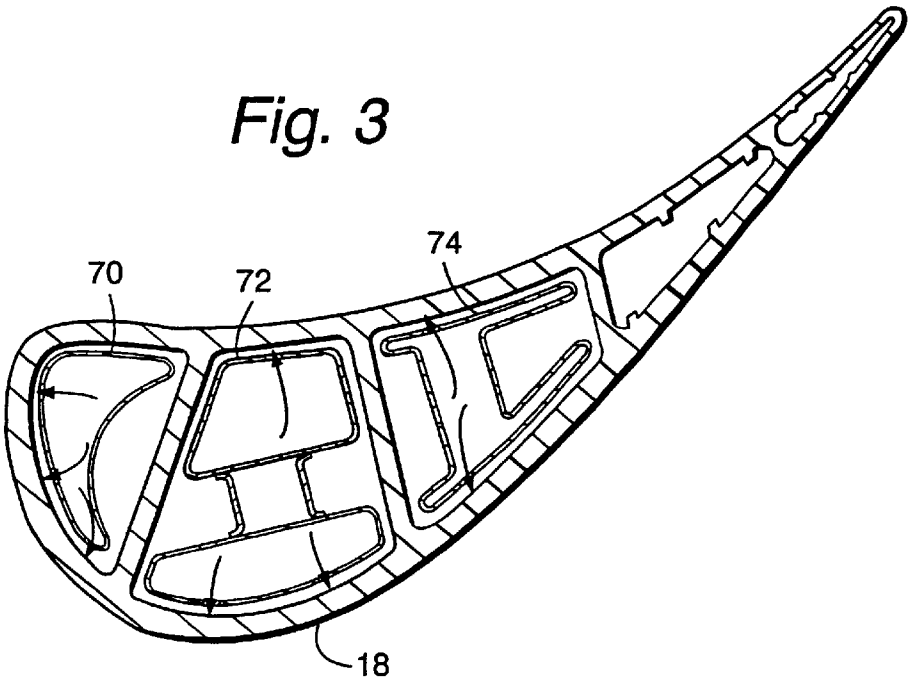
FIG. 3 is a cross-sectional view taken generally about on line 3—3 in FIG. 1.
Figure 2:
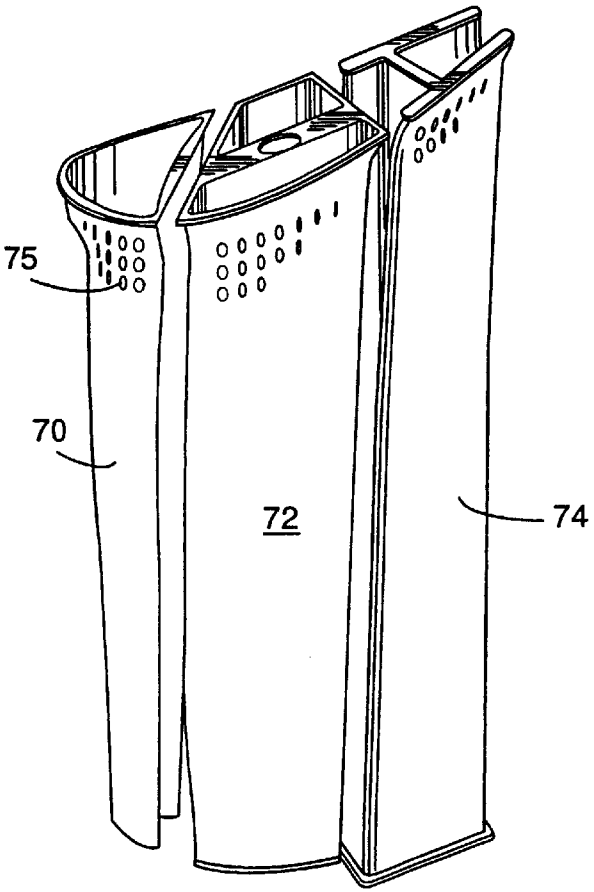
FIG. 2 is a perspective view of inserts for the first, second and third cavities of the vane.
Figure 4:
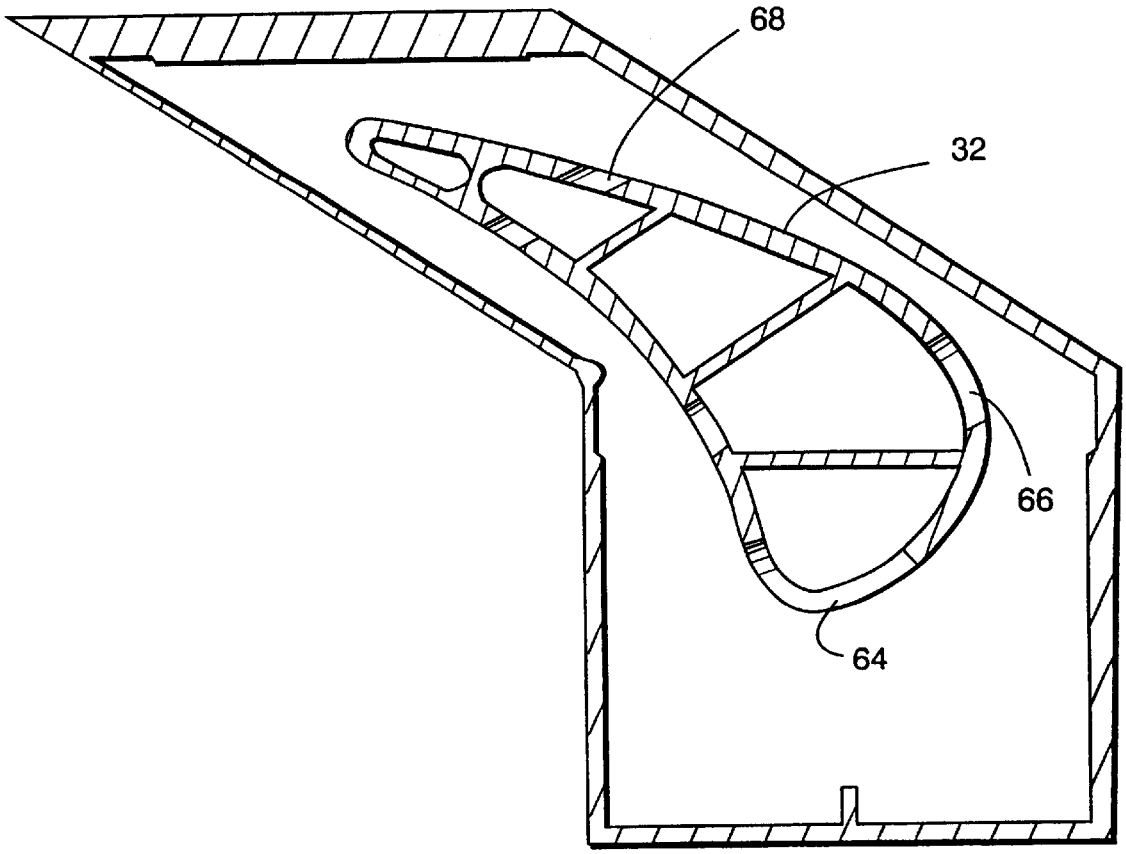
FIG. 4 is a cross-sectional view illustrating the vane extension above the outer wall of the outer band and the steam inlet apertures through the vane extension.

Referring now to the drawings, particularly to FIG. 1, there is illustrated a nozzle vane segment, generally designated 10, comprised of an outer band 12 and an inner band 14 in part defining a hot gas path 16 through the turbine of which the vane segment forms a part. The outer and inner bands 12 and 14 are connected by vanes 18. It will be appreciated that the outer and inner bands and vanes are provided in segments and the segments are disposed in an annular array about the axis of the turbine. The space between the outer and inner bands and containing the vanes defines the gas flow path 16 through the turbine.

The outer band 12 includes an outer band wall 20 in part defining the hot gas path 16 and a first cover 22 formed of forward and aft first covers 24 and 26, respectively. The inner band 14 includes an inner wall 28 in part defining the gas path 16 and a second inner cover 30.

Figure 5:
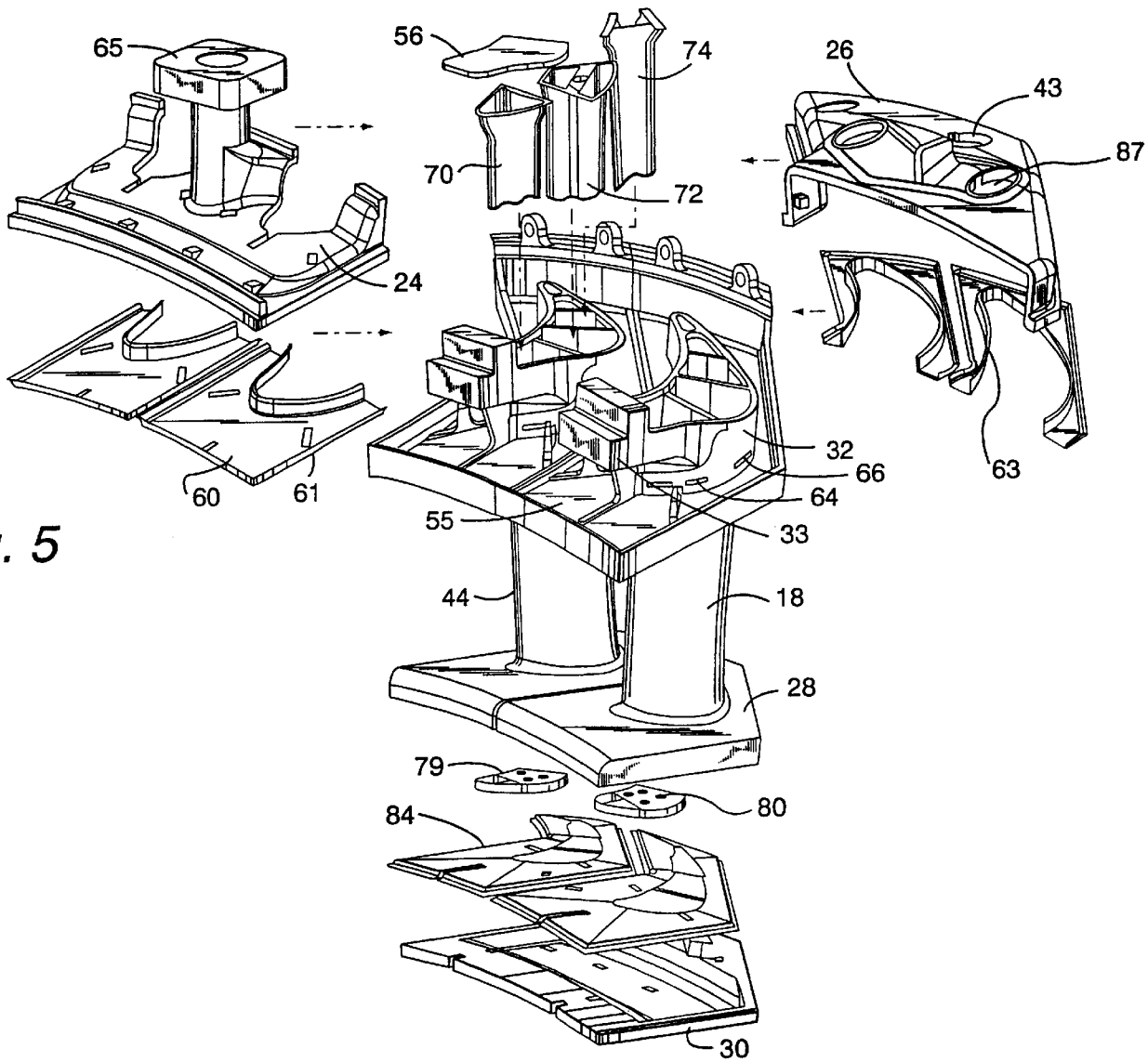
FIG. 5 is an exploded perspective view illustrating various parts of a stator vane segment in doublet form.

The vane 18 extending between the outer and inner bands 12 and 14, respectively, includes, as best illustrated in FIG. 5, a vane extension 32 having a forward hook 33 for securing the segment to the fixed casing of the turbine, not shown, and which vane extension facilitates flow of a cooling medium as will become clear from the ensuing description. The vane 18 is divided into cavities, and in a preferred embodiment, the cavities comprise first, second, third, fourth and fifth cavities 34, 36, 38, 40 and 42, respectively. The cavities are arranged in sequence from a leading edge 44 of the vane to the trailing edge 46 by internal ribs 48, 50, 52 and 54. As illustrated in FIG. 5, a unitary cover 56 overlies and closes the first and second cavities 34 and 36 and a further vane cover, not shown, overlies cavity 40.

The outer band 12 includes a compartment 55 (FIG. 5) divided into outer and inner chambers 56 and 58, separated from one another by a first impingement plate 60. The first impingement plate is provided in forward and aft first impingement plate sections 61 and 63, respectively, for extending about the vane extension 32. First impingement plate 60 includes a plurality of impingement openings for directing steam from the outer chamber 56 of the outer band to the inner chamber 58 of the outer band. It will be appreciated that the forward cover 24 includes, as illustrated in FIG. 5, a steam inlet 65 for supplying steam to the outer chamber 56. The vane extension 32 includes lateral openings 64, 66 and 68 through the vane extensions into the first, second and fourth cavities 34, 36 and 40, respectively, for delivering spent impingement steam into the cavities.

Each of the first and second cavities includes an insert open at radially outer ends and closed at radially inner ends. The third cavity has an insert 74 open at the inner end and closed at its outer end. The inserts 70 and 72 in the first and second cavities include a collar adjacent their radial outer ends for directing steam received from the lateral openings 64 and 66 through the open upper ends of the inserts into the interior of the inserts. The inserts 70, 72 and an additional insert 74 in the third cavity 38 include a plurality of impingement cooling openings 75 in the walls thereof for impingement cooling the opposite side walls of the vane.

The inner band 14 includes a compartment 81 (FIG. 1) divided into inner and outer chambers 82 and 86, respectively. The lower ends of the inserts 70 and 72 have cavity guides 79. Guides 79 direct the spent cooling steam into the radially inner chamber 82 radially inwardly of an impingement plate 84 in the inner band 14. Openings 80 in cavity guides 79 meter the spent steam from cavity 36 and provide for instrumentation tubing not shown. Thus, the cavity guides 79 direct the spent cooling steam into the inner chamber 82 where the steam reverses direction and flows through the impingement cooling openings of the second impingement plate 84 for cooling the inner wall 28 of the inner band 14. The insert 74 in the third cavity opens into the outer chamber 86 between the impingement plate 84 and inner wall 28 for returning spent impingement steam through the third cavity and impingement cooling the side walls of the vane adjacent the third cavity. The spent steam then flows through the vane extension to a steam exhaust 87 in the aft cover 26.

As illustrated in FIG. 1, the fourth cavity 40 receives steam through the lateral opening 68 for convective cooling the vane walls, there being no insert in the fourth cavity. The steam passes through the fourth cavity into the inner chamber 82 of the inner band 14 and combines with the spent impingement cooling steam from the first and second cavities for impingement cooling the inner band 28 and return through the third cavity 38.

The final cavity 42 adjacent the trailing edge lies at its radial outer end in communication with a cooling air inlet port (FIG. 5) through the first aft cover 26. Cooling air, preferably compressor discharge air, is thus admitted into the fifth cavity 42. A plurality of turbulators 90 are provided along the opposite side walls of the fifth cavity 42 to disrupt the boundary layer of the cooling air and provide efficient cooling of the trailing edge. The spent cooling air exits from the fourth cavity through an opening 45 into the wheelspace of the turbine.

In use, the steam flows into the outer chamber 56 of the outer band 12 through the steam inlet port 65 in the forward cover 24. The steam necessarily flows through the first impingement openings of the first impingement plate 60 for impingement cooling the outer wall 20 of the outer band 12. The spent impingement cooling steam flows through the lateral openings 64, 66 and 68 of the first, second and fourth cavities. Because the cavities are closed at their upper ends by cover plates, the steam flows radially inwardly and within the inserts 70 and 72. In the first and second cavities, the steam flows outwardly through the impingement cooling holes in the walls of the inserts for impingement cooling of the registering side walls of the vane. The spent cooling steam from the first and second cavities flows radially to the inner band 14 exiting into the inner chamber 82 through the guides 79. The steam from the lateral opening 68 flows through the fourth cavity 40 in a radial inward direction to convectively cool the vane walls and into the chamber 82. The steam in chamber 82 from cavities 34, 36 and 40 flows through impingement openings in first impingement plate 84 into the outer chamber 86 of the inner band 14. This spent cooling steam lies in communication with the radial inner end of the third cavity insert 74 for flow radially outwardly along the insert 74. The returning steam flow also flows through impingement openings in the insert 74 for impingement cooling of the opposite side walls of the vane adjacent the third cavity. The spent steam then flows out of the segment through the steam exit port 87 in the aft cover 26. Simultaneously, compressor discharge air flows into the fifth cavity 42 and radially inwardly therealong for cooling the trailing edge 46. The spent cooling air discharges through the inner band into the wheelspace of the rotor.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A turbine vane segment, comprising:

inner and outer bands spaced from one another and having inner and outer walls, respectively, in part defining a gas path through the turbine;

a vane extending in the gas path between said inner and outer bands and having leading and trailing edges, said vane including a plurality of discrete cavities between the leading and trailing edges and extending lengthwise of said vane for flowing a cooling medium;

a cooling medium inlet for said segment for enabling passage of the cooling medium into a compartment of said outer wall;

said cavities including first, second, third, fourth and fifth cavities in sequential order from said leading edge toward said trailing edge, said vane having openings in communication with said compartment and said first, second and fourth cavities to enable passage of the cooling medium from said compartment into said first, second and fourth cavities for flow in a generally radially inward direction along said first, second and fourth cavities;

said vane having openings in communication between a compartment of said inner wall and said first, second and fourth cavities for flowing the cooling medium from said first, second and fourth cavities into the compartment of said inner band;

said vane having an opening in communication with said compartment of said inner band and said third cavity for flowing the cooling medium generally radially outwardly through said third cavity and outwardly of the vane segment.

2. A turbine vane segment according to claim 1 including openings through said inner and outer walls for flowing a second cooling medium generally radially inwardly along said fifth cavity.

3. A turbine vane segment according to claim 2 wherein said fifth cavity lies along the trailing edge of said vane and comprises the last of said cavities in sequential order from the leading edge to the trailing edge.

4. A turbine vane segment according to claim 1 wherein said vane has solely five cavities.

5. A turbine vane segment according to claim 1 including first, second and third insert sleeves in said first, second and third cavities, respectively, and spaced from interior wall surfaces of the respective cavities, each insert sleeve having an inlet for flowing the cooling medium into the insert sleeve and impingement openings for flowing the cooling medium through the sleeve openings into the space between the sleeve and the cavity for impingement cooling interior wall surfaces of said vane, said first and second sleeves being spaced from and defining respective channels with said interior wall surfaces of said first and second cavities for flowing spent impingement cooling medium from said channels to said compartment of said inner wall, said third sleeve being spaced from and defining a channel with said interior wall surface of said third cavity for receiving the cooling medium flowing through the openings of said third insert sleeve from said compartment of said inner wall and channeling the flow generally radially outwardly of the vane.

6. A turbine vane segment according to claim 5 wherein said insert lie solely in said first, second and third cavities, respectively, said fourth and fifth cavities being void of impingement cooling inserts.

7. A turbine vane segment, comprising:

inner and outer bands spaced from one another and having inner and outer walls, respectively, in part defining a gas path through the turbine;

a vane extending in the gas path between said inner and outer bands and having leading and trailing edges, said vane including a plurality of discrete cavities between the leading and trailing edges and extending lengthwise of said vane for flowing a cooling medium;

a first cover for said outer band spaced outwardly of said outer wall, a first impingement plate between said first cover and said outer wall in part defining outer and inner chambers on opposite sides of said impingement plate, a cooling medium inlet for said segment for enabling passage of the cooling medium into said outer chamber, said impingement plate having openings for flowing the cooling medium from said outer chamber into said inner chamber through said openings for impingement cooling of said outer wall;

said cavities including first, second, third, fourth and fifth cavities in sequential order from said leading edge toward said trailing edge, said vane having openings in communication with said inner chamber and said first, second and fourth cavities to enable passage of the cooling medium from said inner chamber into said first, second and fourth cavities for flow in a generally radially inward direction along said first, second and fourth cavities;

a second cover for said inner band spaced inwardly from said inner wall, a second impingement plate between said second cover and said inner wall in part defining outer and inner chambers on opposite sides of said second impingement plate, said vane having openings in communication with said inner chamber of said inner wall and said first, second and fourth cavities for flowing the cooling medium from said first, second and fourth cavities into said inner chamber of said inner band, said second impingement plate having openings for flowing the cooling medium from said inner chamber of said inner band through said openings of said second impingement plate into said outer chamber of said inner band for impingement cooling said inner wall;

said vane having an opening in communication with said outer chamber of said inner band and said third cavity for flowing the cooling medium generally radially outwardly through said third cavity and outwardly of the vane segment.

8. A turbine vane segment according to claim 7 including openings through said inner and outer walls for flowing a second cooling medium generally radially inwardly along said fifth cavity.

9. A turbine vane segment according to claim 8 wherein said fifth cavity lies along the trailing edge of said vane and comprises the last of said cavities in sequential order from the leading edge to the trailing edge.

10. A turbine vane segment according to claim 7 wherein said vane has solely five cavities.

11. A turbine vane segment according to claim 7 including first, second and third insert sleeves in said first, second and third cavities, respectively, and spaced from interior wall surfaces of the respective cavities, each insert sleeve having an inlet for flowing the cooling medium into the insert sleeve and impingement openings for flowing the cooling medium through the sleeve openings into the space between the sleeve and the cavity for impingement cooling interior wall surfaces of said vane, said first and second sleeves being spaced from and defining respective channels with said interior wall surfaces of said first and second cavities for flowing spent impingement cooling medium from said channels to said inner chamber of said inner wall, said third sleeve being spaced from and defining a channel with said interior wall surface of said third cavity for receiving the cooling medium flowing through the openings of said third insert sleeve from said outer chamber of said inner wall and channeling the flow generally radially outwardly of the vane.

12. A turbine vane segment according to claim 11 wherein said inserts lie solely in said first, second and third cavities, respectively, said fourth and fifth cavities being void of impingement cooling inserts.

* * * * *

UNITED STATES PATENT AND TRADEMARK OFFICE

CERTIFICATE OF CORRECTION

PATENT NO. : 6,517,312 B1
DATED : February 11, 2003
INVENTOR(S) : Jones et al.

It is certified that error appears in the above-identified patent and that said Letters Patent is hereby corrected as shown below:

Column 3,
Line 64, delete “first” after “and a”.
Line 65, delete “first” after “and aft”.
Line 67, delete “second” after “and a”.

Column 4,
Line 17, delete “by a first impingement plate 60. The first" and insert -- by an first impingement plate 60. The --.
Line 18, delete “first” after “and aft”.
Line 20, delete “First impingement -- and insert -- Impingement --.
Line 51, delete “second” after “openings of the”.

Column 5,
Lines 3 and 13, delete “first” after “through the”.
Line 14, delete “first” after “openings of the”.
Line 30, delete “first” after “openings in”.

Signed and Sealed this

Fifteenth Day of July, 2003

JAMES E. ROGAN
*Director of the United States Patent and Trademark Office*